US006041554A

United States Patent [19]

McArthur, Jr.

[11] Patent Number: 6,041,554

[45] Date of Patent: *Mar. 28, 2000

[54] CONTINUOUS FOOT EXTENSION SUPPORT FOR TELESCOPING SEATING SYSTEM WITH FOOT LEVEL AISLE

[76] Inventor: Louis Robert McArthur, Jr., 105 Mill St., Cornith, N.Y. 12822

[ * ] Notice: This patent is subject to a terminal disclaimer.

[21] Appl. No.: 08/961,819

[22] Filed: Oct. 31, 1997

[51] Int. Cl.[7] ..... F04H 3/12

[52] U.S. Cl. ..... 52/9; 52/183

[58] Field of Search ..... 52/6–9, 73, 182, 52/183

[56] References Cited

U.S. PATENT DOCUMENTS

| | | | |
|---|---|---|---|
| 4,045,921 | 9/1977 | Molloy | 52/9 |
| 4,155,202 | 5/1979 | Hartman | 52/9 |
| 4,189,876 | 2/1980 | Crossman et al. | 52/9 |
| 4,363,197 | 12/1982 | Aurit | 52/9 |
| 4,565,036 | 1/1986 | Lyman, Jr. | 52/9 |
| 5,369,918 | 12/1994 | Ben | 52/9 |
| 5,605,025 | 2/1997 | Paddock | 52/741.3 |
| 5,784,835 | 7/1998 | McArthur | 52/9 |

OTHER PUBLICATIONS

Brochure entitled, "Sheridan Gymnasium Equipment Ltd.," distributed by Manufacturers Applied Renovation Systems, Inc. (M.A.R.S., Inc.), Bleacherman–Locker Doctors, 105 Mill Street, Corinth New York, 12822.

Brochure entitled, "Interkal Telescopic Seating Systems," published by Interkal Inc., 5981 East Cork Street, P.O. Box 2107, Kalamazoo, Michigan, 49003–2107, Brochure No. 13125/INT/Buyline 2982.

Brochure entitled, "Spectator Seating Systems," published by Kodiak Industries, Ltd., 49 Adelaide Street, Winnipeg R3A OV8, Canada.

Brochure entitled, "From Concept to Reality With Hussey," published by Hussey Seating Company, North Berwick, Maine, 03906, Brochure No. 13125/HUS/BuyLine 0099.

Brochure entitled, "Universal Telescoping Seating Systems," published by Interkal Inc., 5981 East Cork Street, P.O. Box 2107, Kalamazoo, Michigan, 49003–2107, Brochure No. 13125/INU/Buyline 2390.

*Primary Examiner*—Beth Aubrey
*Attorney, Agent, or Firm*—Heslin & Rothenberg, P.C.

[57] ABSTRACT

A support structure for a telescoping seating system includes a wheel and wheel extension coupled to the underside of a foot extension. The next lowest foot extension provides continuous support for the wheel throughout the opening and closing of the seating system. Methods for enhancing structural support for and providing a foot-level aisle in a telescoping seating system are also provided.

37 Claims, 10 Drawing Sheets

CONTINUOUS FOOT EXTENSION SUPPORT FOR TELESCOPING SEATING SYSTEM WITH FOOT LEVEL AISLE

BACKGROUND OF THE INVENTION

1. Technical Field

The present invention generally relates to telescoping seating systems. More particularly, the present invention relates to support structures for foot extensions in telescoping seating systems.

2. Background Information

Currently, many telescoping seating systems suffer unnecessary deterioration, due to an insufficient support structure. For example, when such telescoping seating systems are closed, downward loads on the foot extensions, which are suspended from one end like a diving board, eventually cause structural fatigue to the foot extensions, becoming a safety concern, as well as ceasing to retain the desired horizontal position during storage and opening. Such downward loads can be caused by, for example, children climbing the front of the seating system when closed or partially opened.

In the past, it has been proposed to address the problem by adding a wheel to the underside of the foot extensions such that when in the closed position, the wheel rests upon the seat of the next lower foot extension. However, a wide gap between the seat and support columns must be traversed by the wheel without support during opening and closing. Over time, the structural fatigue experienced by the foot extensions from downward loads causes the wheels to get stuck on the seats or other support members. Further, it fails to address the partially opened situation mentioned above.

Thus, a need exists for an improved telescoping seating system that provides support for the foot extensions throughout the opening and closing of the seating system.

SUMMARY OF THE INVENTION

Briefly, the present invention satisfies the need for a support structure for the foot extensions throughout the opening and closing of the telescoping seating system by providing continuous support for a wheel and wheel extension coupled to the underside of the foot extension throughout opening and closing.

In accordance with the above, it is an object of the present invention to reduce the damage to telescoping seating systems from downward loads when in the closed position.

It is another object of the present invention to reduce the damage to telescoping seating systems from downward loads when in a partially opened position.

The present invention provides, in a first aspect, a support structure for a telescoping seating system including a plurality of seating levels, each seating level above the lowest seating level including a foot extension member. The support structure comprises a support member coupled to or integral with the lower surface of the first foot extension member of the first seating level and extending downward toward the upper surface of the second foot extension member of the second seating level directly below the first seating level. The support structure further comprises a wheel coupled to the support member, wherein the upper surface of the second foot extension member continuously supports the wheel between a closed position and an opened position of the telescoping seating system.

In another aspect, the present invention provides a telescoping seating system comprising a plurality of seating levels, where each seating level above a lowest seating level includes a foot extension member. The telescoping seating system further comprises a support member coupled to or integral with the lower surface of each foot extension member and extending downward toward the upper surface of the foot extension member of the next lower seating level. A wheel is coupled to each support member, and each wheel is continuously supported between the closed position and the opened position of the telescoping seating system by the upper surface of the foot extension member of the next lower seating level.

In yet another aspect, the present invention provides a method of enhancing structural support for a telescoping seating system. The method comprises steps of: providing a telescoping seating system including a plurality of seating levels, where each seating level above a lowest seating level includes a foot extension member; and continuously supporting each foot extension member between an opened position and a closed position of the telescoping seating system.

In yet another aspect, the present invention provides a method of providing a foot-level aisle in a telescoping seating system including a plurality of seating levels, where each seating level above a lowest seating level includes a foot extension member. The method comprises steps of: providing a support member coupled to or integral with the underside of a foot extension member; and coupling a wheel to the support member, so that the wheel is continuously supported between a closed position and an opened position of the telescoping seating system.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
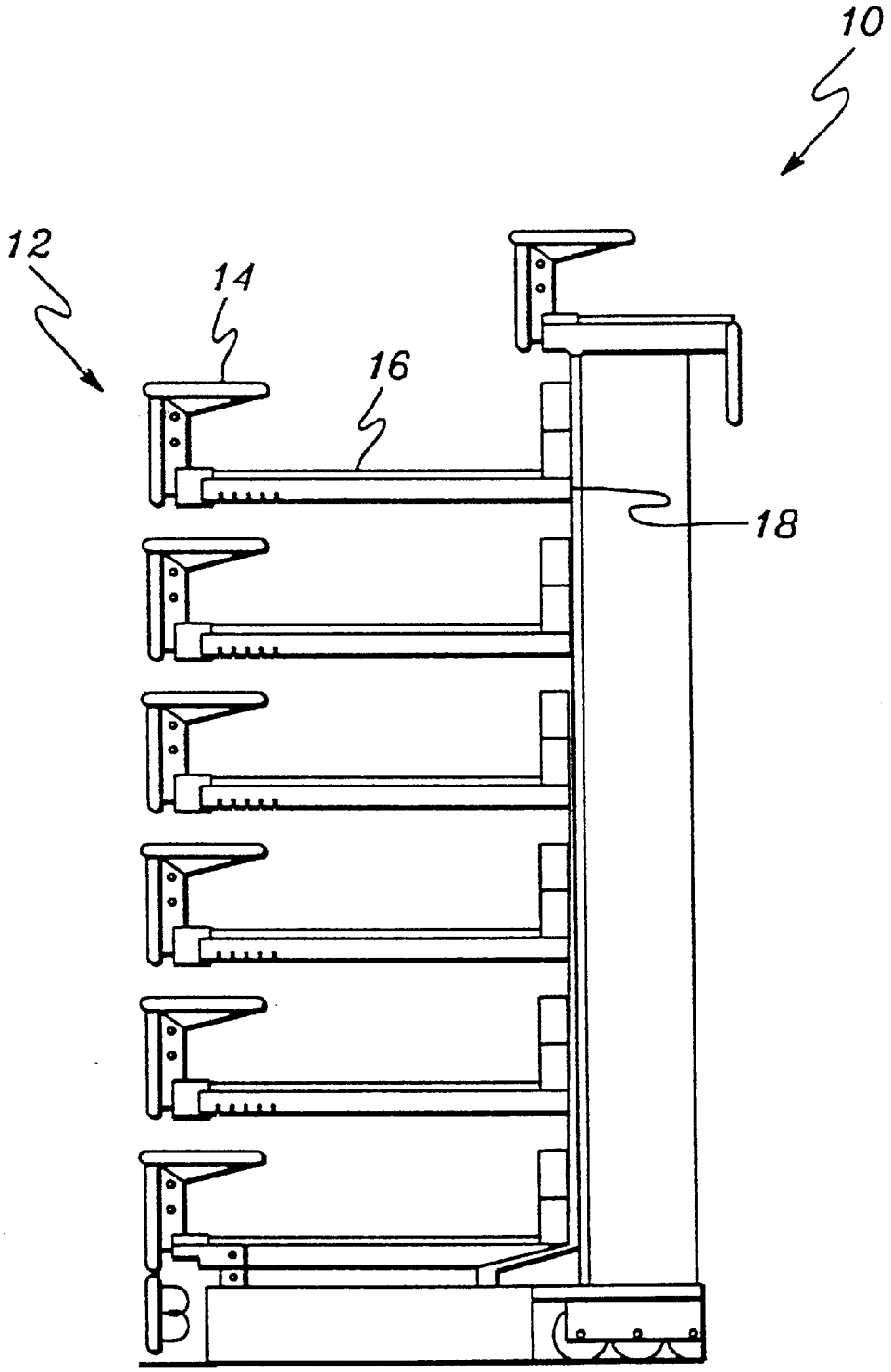
fig. 1 PRIOR ART
FIG. 1 depicts a prior art telescoping seating system.

FIG. 1 depicts a prior art telescoping seating system 10 shown in the fully retracted or closed position. System 10 comprises a plurality of extension members (e.g., extension member 12). Extension member 12 comprises seat member 14 and foot board 16. When system 10 is completely opened (not shown), each extension member (other than the lowest level) is supported by a support column. However, when in the closed position as shown, the extension members are not supported. Thus, any downward loads placed on the extension members when the telescoping seating system is in the closed position causes deterioration of the connection 18 for the extension member.

Figure 2:
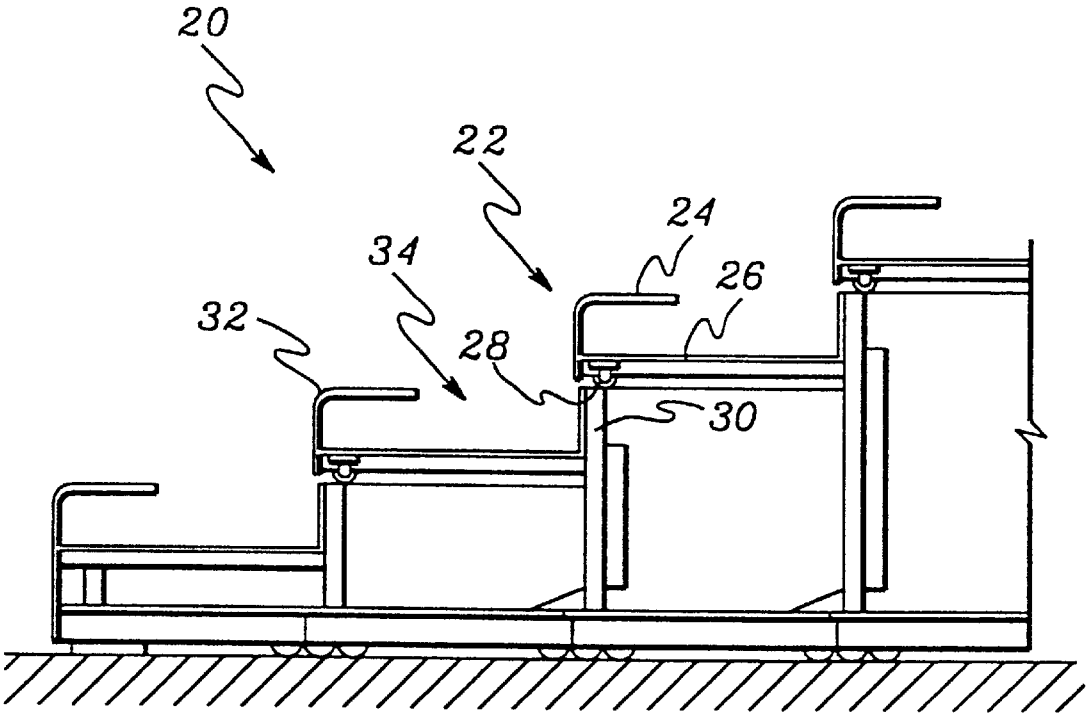
fig. 2 PRIOR ART
FIG. 2 depicts another prior art telescoping seating system.

One proposed solution to this problem is shown in FIG. 2. FIG. 2 depicts another prior art telescoping seating system 20. System 20 comprises a number of extension members, similar to system 10 of FIG. 1. For example, extension member 22 comprises seat member 24 and foot board 26. However, extension member 22 also includes a wheel 28 attached to a bottom surface of foot board 26. When system 20 is in the closed position (not shown), wheel 28 is intended to rest on seat 32. However, between the opened and closed positions, wheel 28 must traverse open area 34 without support. Wheel 28 could cause difficulty in obtaining the opened and closed positions, since there is no continuous support therefor. Moreover, there may be no or insufficient support for wheel 28 if system 20 is only partially opened.

The present invention solves this problem by providing a surface for continuous support of a wheel between the opened and closed positions.

In the recent past, standards adopted by the National Fire Protection Association (hereinafter, the "NFPA") for folding and telescoping seating, have begun to require that entry and exit aisles be provided at predetermined intervals. Manufacturers of new telescoping seating systems and owners of existing systems have complied with the requirements by outfitting their seating systems with integrated aisles. The present invention takes advantage of the aisles so provided by recognizing that they afford a continuous support surface that was absent in the telescoping seating system of FIG. 2. The support structure of the present invention is preferably installed in the aisle sections of new or existing telescoping seating systems which have foot level aisles in order to provide continuous support of all foot extension members.

Figure 3:
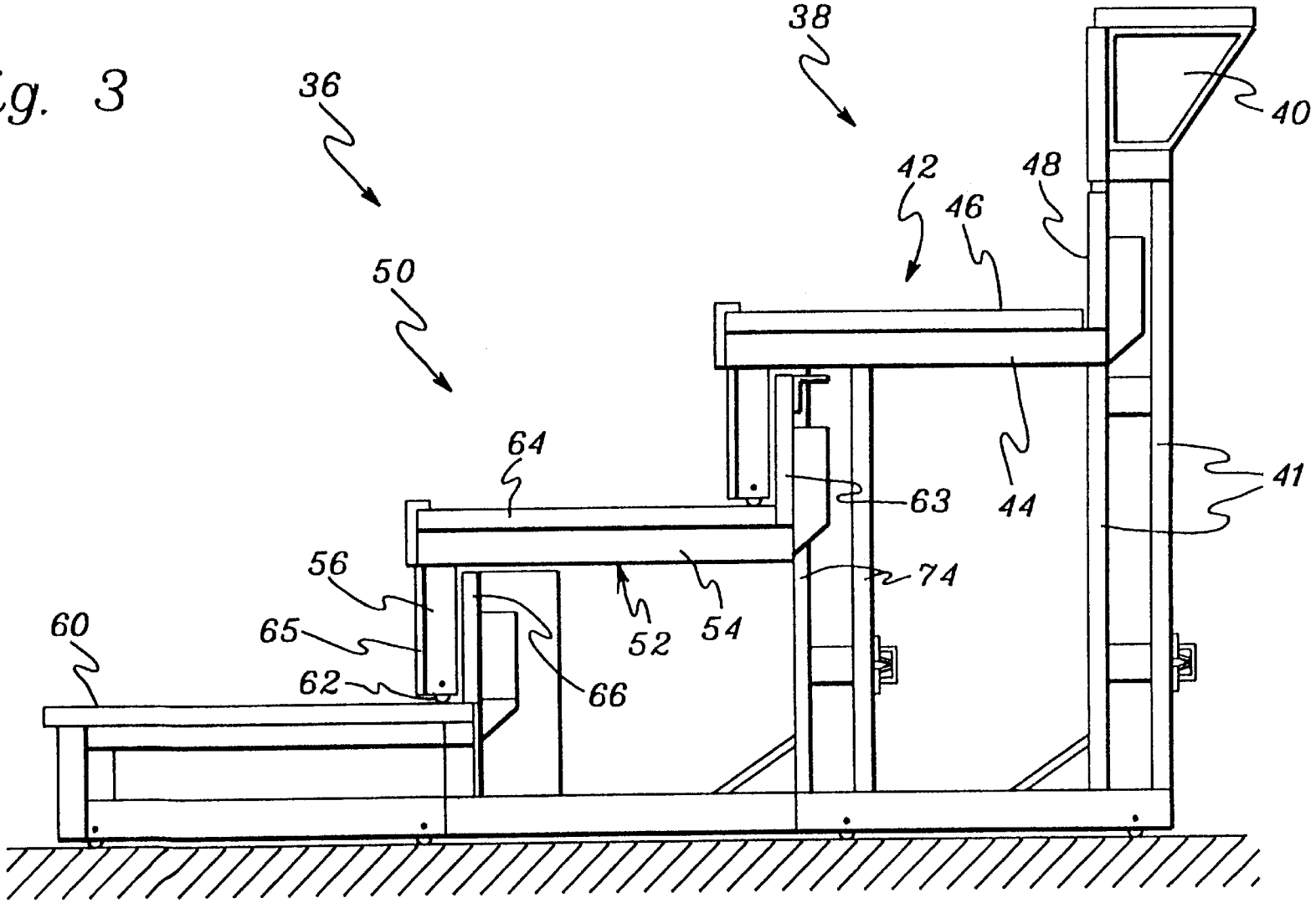
FIG. 3 depicts a telescoping seating system according to the present invention in the fully opened position.

One embodiment of the support structure of the present invention is shown in FIG. 3. FIG. 3 is a cross-sectional view of a fully extended telescoping seating system 36, taken at a foot-level aisle, in accordance with the present invention. Note that the seating for system 36, except for the top level, is intentionally left out for clarity. As used herein, the term "telescoping seating system" refers to seating systems that can be retracted when not in use, and may be mobile or fixed. An example of a telescoping seating system is gymnasium bleachers. System 36 comprises a plurality of seating levels, for example, seating level 38. Seating level 38 comprises seat member 40, foot extension member 42 and heel board or heel member 48. Seat member 40 is affixed to a rear wall (not shown), however, it will be understood that the present invention is also useful for fully mobile telescoping seating systems.

In all seating levels other than the highest seating level, the foot extension member is coupled through the support columns to the foot extension member of the next higher seating level when the seating system is fully extended. Foot extension member 42 is supported by fixed support column 41 and comprises foot board support 44, foot board 46 (the surface that a person's feet would actually rest on) and heel board or heel member 48. If people were sitting at a given seating level, for example, seating level 38, and were to move their feet backwards, the heels would intercept heel member 48, hence the name. As used with respect to the present embodiment, the term "foot extension member" refers to the combination of foot board support and foot board. However, it will be understood that a foot extension member may be an integrated unit, or may comprise less or more members in actual practice. For example, it could be a single member with integral heel board. At an aisle, as in FIG. 3, the foot boards and foot board supports of the various seating levels act as stairs.

Seating level 50, like seating level 38, comprises foot extension member 52. Foot extension member 52 is supported by mobile support column 74, and comprises foot board support 54 and foot board 64. Wheel extension 56 is attached to the underside of foot board support 54 as shown. Wheel extension 56 is coupled to wheel 62 at its lower end. Wheel 62 rests on the upper surface of foot board 60. Heel board 66, shown directly adjacent wheel extension 56 and wheel 62, serves as a stop for the wheel and wheel extension. For safety and aesthetic reasons, an aisle closure plate 65 covers wheel extension 56 and part of wheel 62, and also acts as a secondary heel board.

As used herein, the term "wheel" refers to any device that allows the thing it is coupled to (here, foot extension member 52) to move relative to a surface (here, the upper surface of foot board 60). As used herein, the term "support member" refers to one or more members providing intermediate support between a wheel and a foot extension member so as to allow the wheel to traverse between the opened and closed positions of the telescoping seating system.

Wheel extension 56 is one embodiment of the support member of the present invention. As used herein, "tubular" means hollow, with a circular, rectangular or other geometrical cross section. Also, as used herein, the term "couple" refers to one member being directly connected to another, or being connected through one or more intermediary members.

Current NFPA standards require a minimum horizontal distance from seat back to seat back of 22 inches, and a space of not less than 12 inches between the back of each seat and the front of the seat immediately behind it. Where the support structure of the present invention is to be installed in an existing telescoping seating system, the dimensions of the equipment from seat back to seat back and between the back of each seat and the front of the seat immediately behind it must exceed the required dimensions above by at least the width of the wheel housing in order for the retrofitted equipment to comply with the standards.

Figure 4:
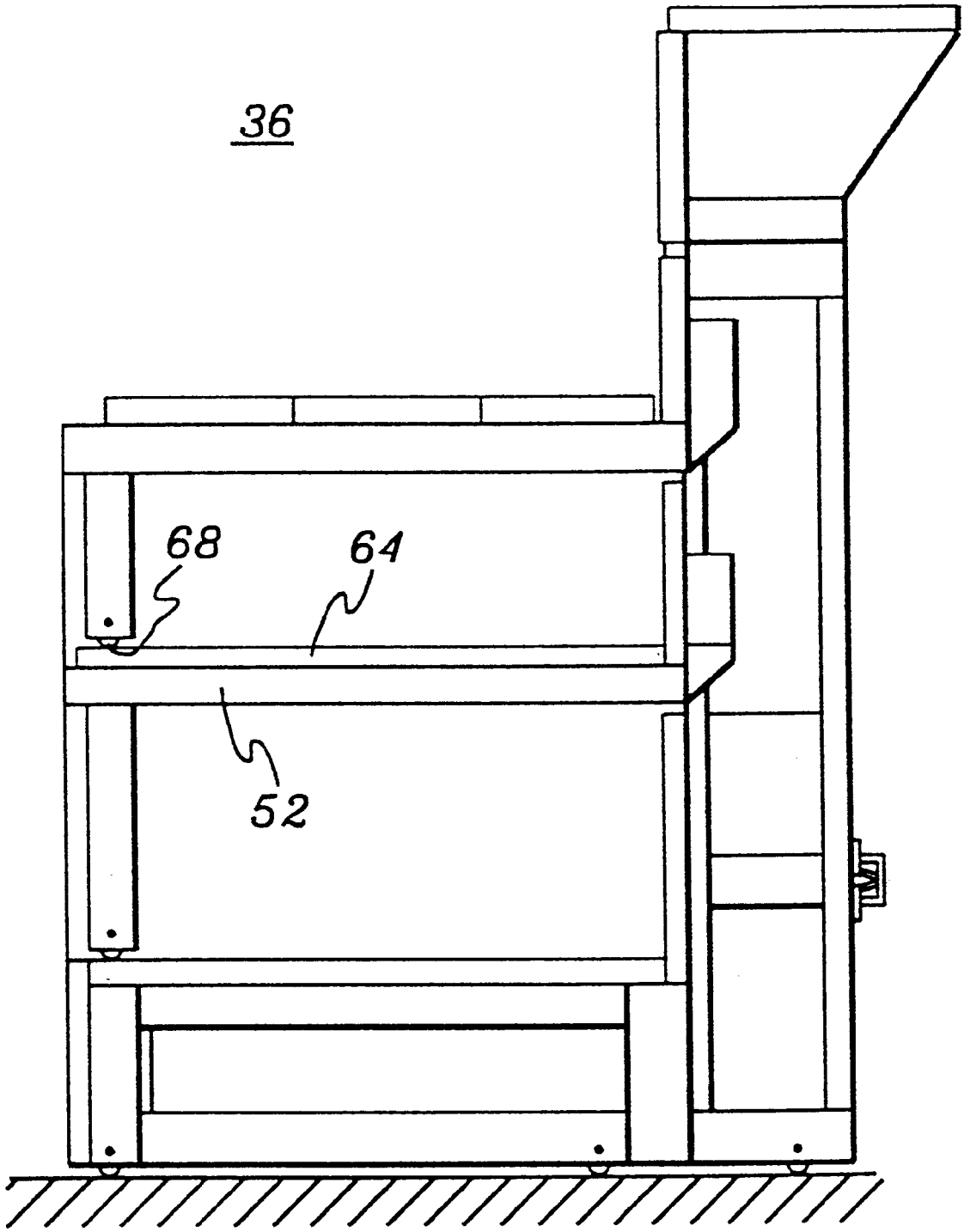
FIG. 4 depicts the telescoping seating system of FIG. 3 in the closed position.

FIG. 4 depicts the telescoping seating system 36 of FIG. 3 in a closed position. In the closed position, wheel 68 rests on the upper surface of foot board 64 of foot extension member 52. Wheels on other seating levels experience the same type of support, thereby preventing the situation described with respect to FIG. 1. In addition, because of the continuous support provided by foot extension member 52, wheel 68 is continuously supported throughout the opening and closing of telescoping seating system 36.

Figure 5:
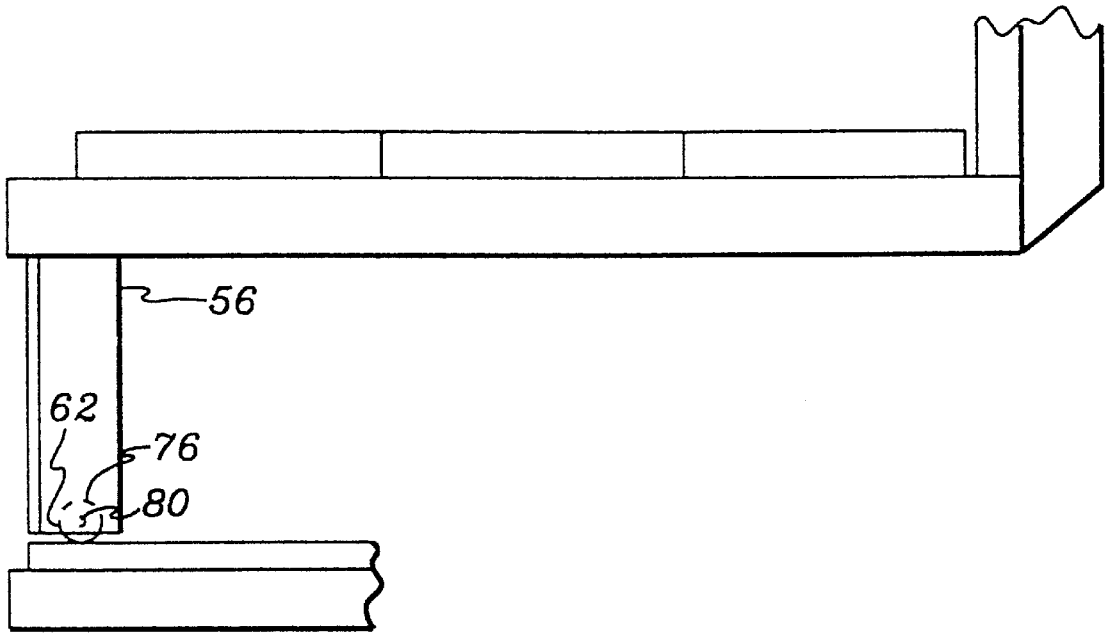
FIG. 5 depicts a wheel from the telescoping seating system of FIG. 3.

FIG. 5 is a close-up view of wheel 62 and wheel extension 56. Wheel 62 comprises wheel portion 76 and axle 80 connecting wheel portion 76 to wheel extension 56. It will be understood that FIG. 5 is merely exemplary and that wheels and methods of connecting a wheel to a foot extension member other than those shown in FIG. 5 could be used.

Figure 6:
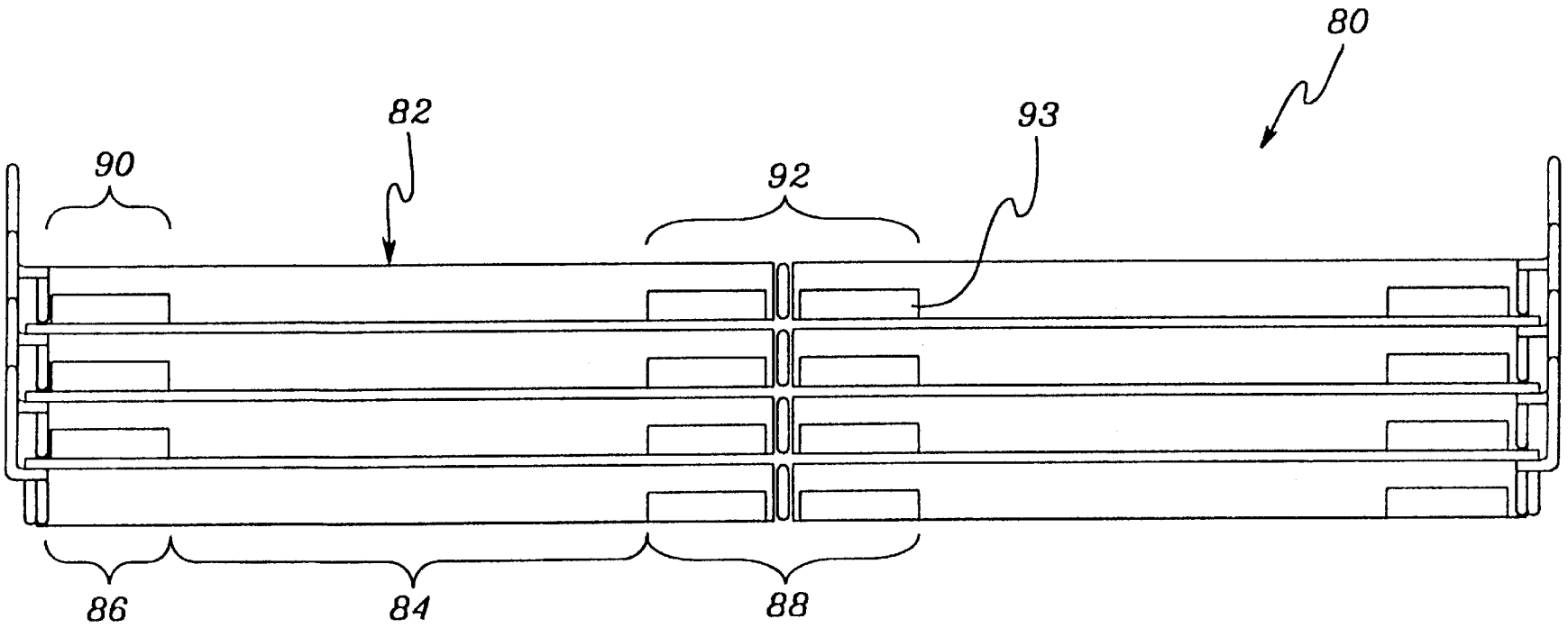
FIG. 6 is a front view of another telescoping seating system according to the present invention.

FIG. 6 depicts a front view of a telescoping seating system 80 with a support structure similar to that of system 36 of FIG. 3. As previously noted, NFPA standards now require aisles to be placed in existing telescoping seating systems at predetermined intervals. For new telescoping seating systems, NFPA standards require integrated aisles. The present invention is useful for telescoping seating systems with foot level aisles and either discontinuous bench-style seating or platform seating (i.e., where attached folding chairs or other stand-alone seating is arranged on the various platform levels). The support structure consisting of a wheel and wheel extension is preferably installed in aisle sections such that the foot extension continuously supports the wheel between a closed and an opened position.

Currently, NFPA standards require that aisles be placed every 27 feet across a seating system. As shown in FIG. 6, seating area 82 spans a distance 84, with aisles 86 and 88 on either side thereof spanning distances 90 and 92, respectively. Each aisle includes an intermediate stair (e.g., intermediate stair 93), described more fully below with respect to FIG. 7. According to the present requirements, for a standard 18 inch wide seat, distance 84 would be about 27 feet, with distance 90 being about 24 inches and distance 92 being about 48 inches. The present requirements result in 24 inches of aisle for every 13 feet 6 inches of seating. However, it will be understood that these requirements may change over time, and may be different in different regions or states, and where other codes are in force.

As used herein, the term "aisle" refers to cooperating stairs in a telescoping seating system allowing a person to travel from one seating level to another. Also, as used herein, the term "predetermined intervals" refers to a predetermined frequency of aisles across the width of a telescoping seating system. As used herein, the term "discontinuous" means that there are one or more horizontal spaces between discrete seat members such that an aisle is formed by the spaces.

Figure 7:
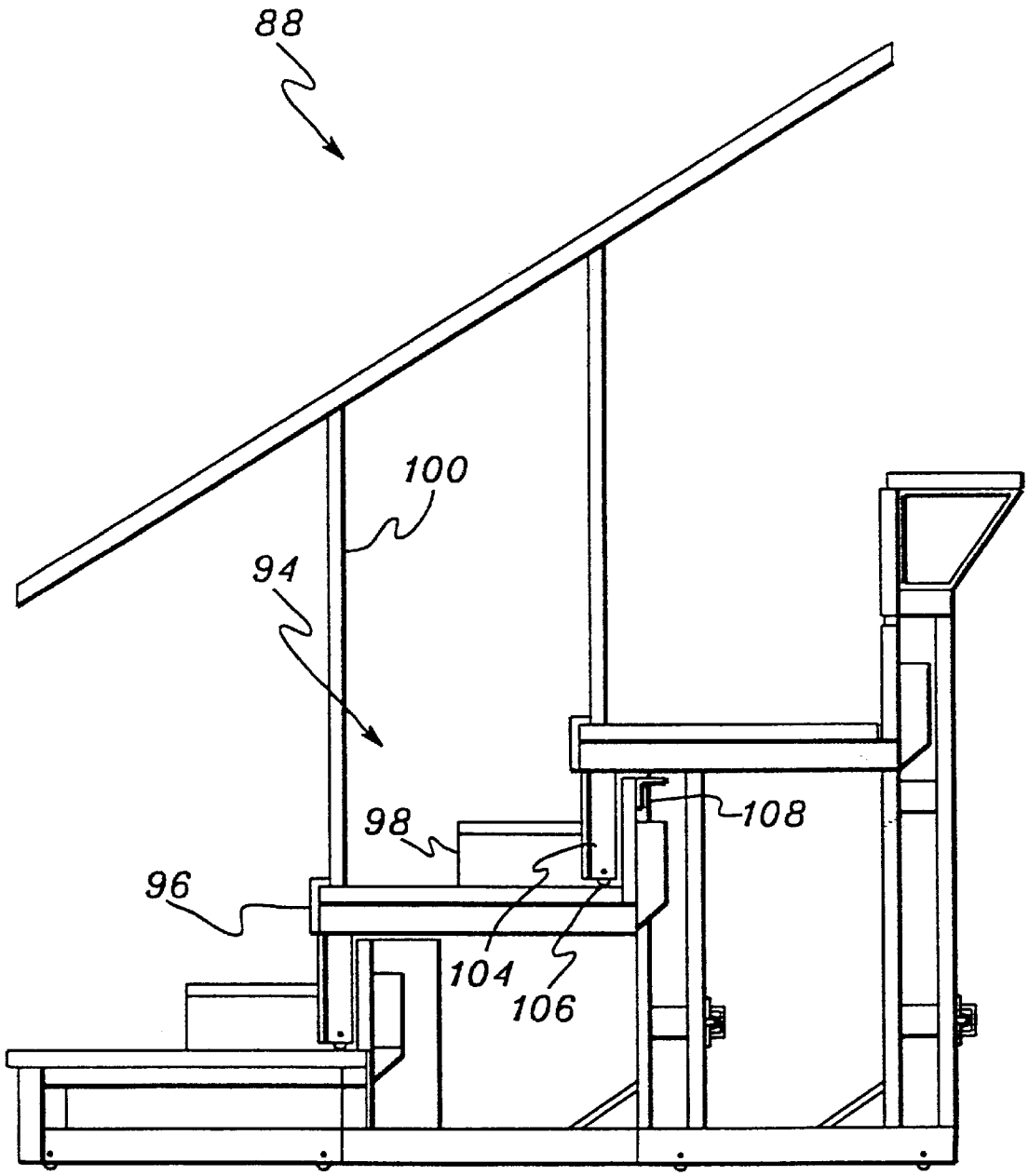
FIG. 7 is a cross sectional view of an intermediate step and hand rail added to the telescoping seating system of FIG. 6 in accordance with the present invention.

In some cases, other safety codes require the inclusion of intermediate steps and railings in aisles, for example, in aisles deeper than 26½ inches and wider than 48 inches. FIG. 7 depicts a second embodiment of the invention, the aisle portion 88 of the telescoping seating system of FIG. 6 including intermediate steps (e.g., intermediate step 98) and a demountable railing 100. Seating level 94 comprises foot extension member 96 and intermediate step 98. Intermediate step 98 is placed on top of foot extension member 96 and coupled thereto so as to immobilize the step with respect to the foot extension member. Intermediate step 98 comprises two sections with gap 102 (see FIG. 9) between the sections. When the telescoping seating system is in the opened position, demountable railing spindle 100 is mounted (see FIG. 8) within the gap 102 and wheel extension 104, wheel 106 and railing spindle occupy the rearward section of the gap adjacent to heel board 108. Railing spindle 100 is removed prior to closing the telescoping seating system to allow wheel extension 104 and wheel 106 to pass through gap 102. "Demountable" refers to the necessity of removing the railing from the aisle before the seating system is closed. The intermediate step provides an additional step at each segment of the foot-level aisle, such that each seating level has two steps in the aisle, one formed by the foot extension member and a second created by the intermediate step. FIG. 6 is exemplary; it will be understood that the railing may be located at any position in or in front of the gap.

Figure 8:
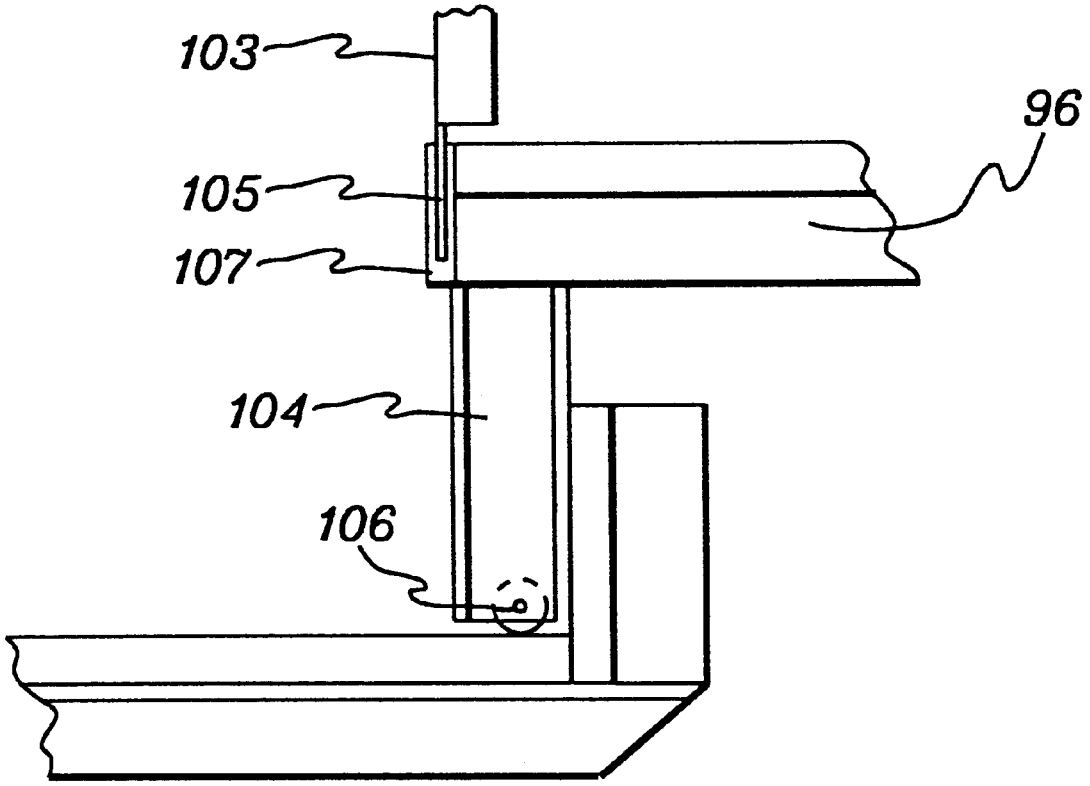
FIG. 8 is close up view of a hand rail mounted in an aisle of the telescoping seating system of FIG. 7 in accordance with the present invention.

FIG. 8 is a close-up view of demountable railing spindle 100, wheel 106 and wheel extension 104. Railing spindle 100 comprises body portion 103 and tongue 105. Tongue 105 is mounted in sleeve 107, which is mounted to the outer edge of foot extension member 96. It will be understood that FIG. 8 is merely exemplary and that railing 100 could be coupled in other ways. Preferably, the demountable railing is coupled so as to cover the intermediate stair gap, thereby discouraging users from walking too close to the gap. Methods of connecting a hand rail at an aisle which include intermediate stairs other than those shown in FIG. 8 could also be used.

Figure 9:
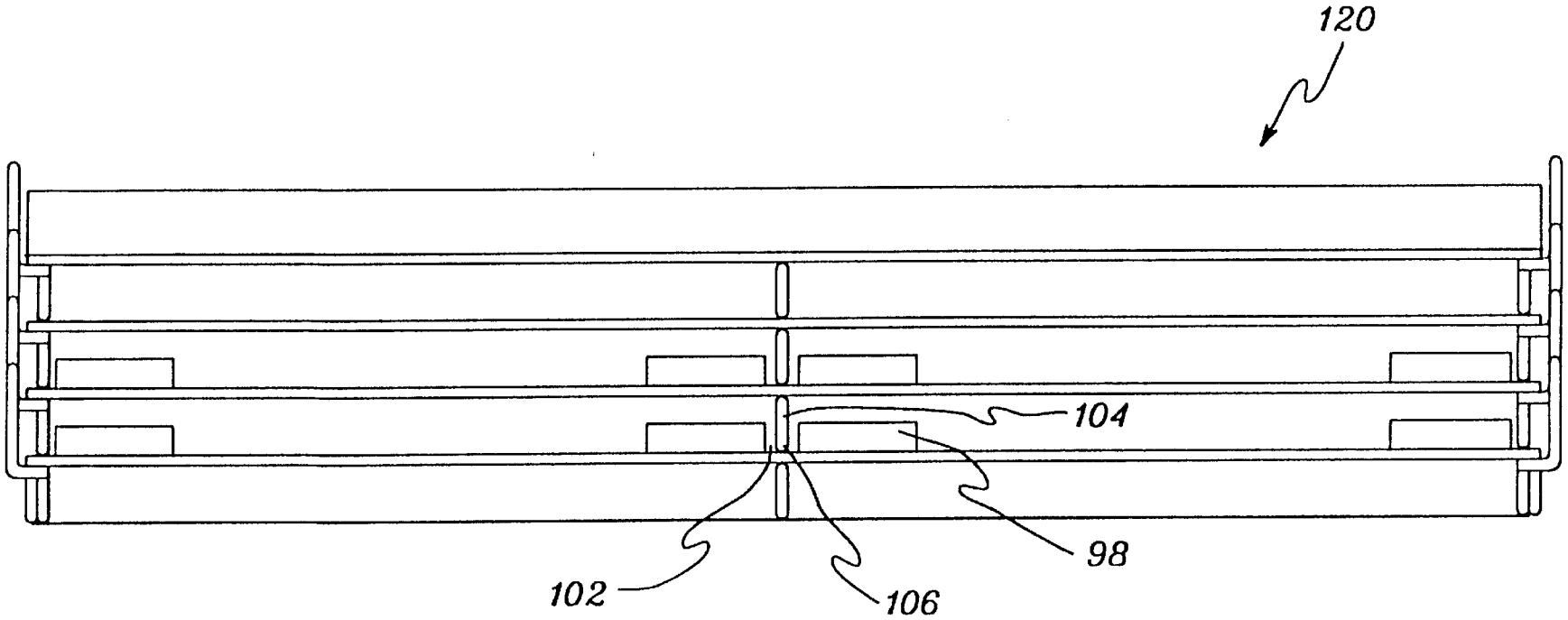
FIG. 9 is a front view of an aisle of the telescoping seating system of FIG. 7 in accordance with the present invention.

FIG. 9 shows a front view of a telescoping seating system 120 in the closed position with the aisle and intermediate steps of FIG. 7. Wheel extension 104 and wheel 106 are mounted within gap 102 of intermediate step 98.

Figure 10:
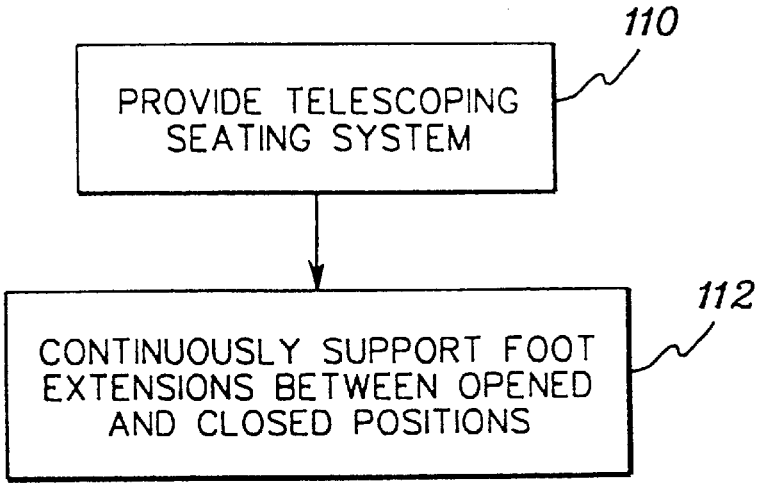
FIG. 10 is a flow diagram of a method of enhancing structural support for telescoping seating system according to the present invention.

FIG. 10 is a flow diagram of a method of enhancing structural support for telescoping seating systems, in accordance with another aspect of the present invention. A telescoping seating system that includes a plurality of seating levels is provided (Step 110, "PROVIDE TELESCOPING SEATING SYSTEM"). Each seating level above a lowest seating level includes a foot extension member. The foot extension members are then continuously supported between an opened position and a closed position of the telescoping seating system (Step 112, "CONTINUOUSLY SUPPORT FOOT EXTENSIONS BETWEEN OPENED AND CLOSED POSITIONS"). The continuous supporting may be accomplished, for example, by the wheel extension 56 and wheel 62 described with respect to FIG. 3.

Figure 11:
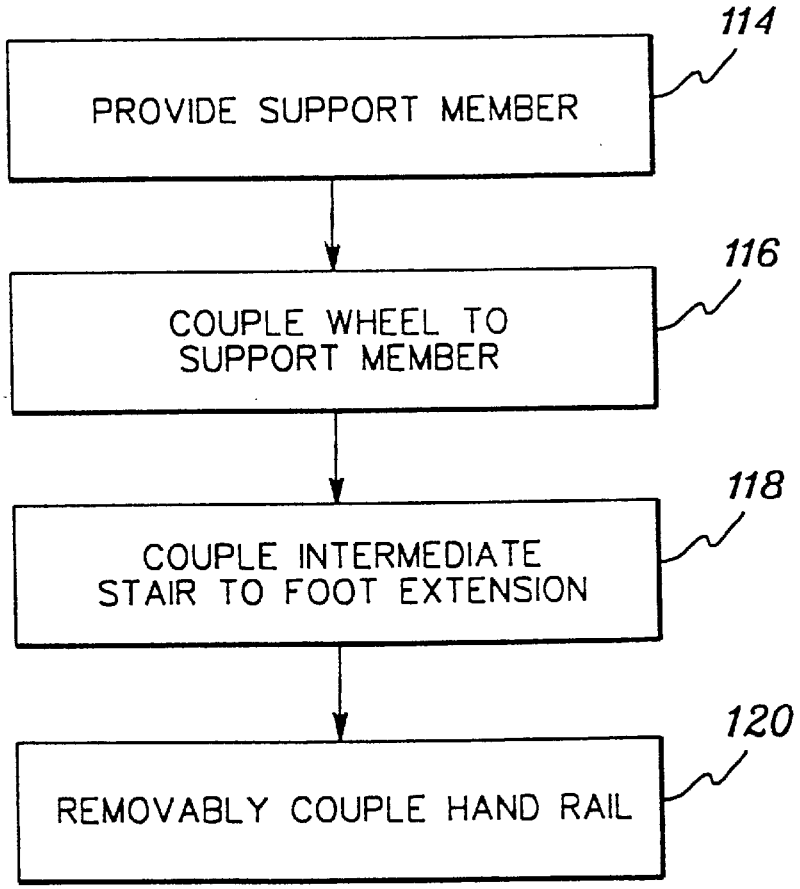
FIG. 11 is a flow diagram of a method of providing a foot-level aisle for a telescoping seating system according to the present invention.

FIG. 11 is a flow diagram of a method of providing foot-level aisles for telescoping seating systems, in accordance with still another aspect of the present invention, that include a plurality of seating levels, where each seating level above a lowest seating level includes a foot extension member. A support member is provided coupled to or integral with the underside of each foot extension member (Step 114, "PROVIDE SUPPORT MEMBER"). Next, a wheel is coupled to the support member so that the wheel is continuously supported between a closed and an opened position of the telescoping seating system (Step 116, "COUPLE WHEEL TO SUPPORT MEMBER").

Where the telescoping seating system includes at least one aisle for ingress and egress, created by discontinuous seat members (i.e., breaks or gaps in the seating across the telescoping seating system), Step 114 may comprise providing the support member in an area of each foot extension member such that it coincides with an aisle in a next lower seating level. Without the seat members in the aisle, the wheel is continuously supported by an upper surface of the foot extension member of the next lower seating level between the closed position and the opened position.

Optionally, an intermediate stair member is coupled to an upper surface of each foot extension member in an area of the upper surface so as to avoid the support member and wheel between the closed and opened positions (Step 118, "COUPLE INTERMEDIATE STAIR TO FOOT EXTENSION"). As shown in FIG. 7, the intermediate stair member may have an opening, and be is coupled to the foot extension member, so that the opening lines up with the support member and wheel. Finally, a hand rail may be removably coupled to the foot extension member when the telescoping seating system is fully opened (Step 120, "REMOVABLY COUPLE HAND RAIL").

While several aspects of the present invention have been described and depicted herein, alternative aspects may be effected by those skilled in the art to accomplish the same objectives. For example, it will be understood that the present invention is applicable not only to telescoping seating systems that are retrofitted to include aisles, but also those built with integrated aisles. The present invention is also applicable to telescoping seating systems with either platform seating or bench seating. Accordingly, it is intended by the appended claims to cover all such alternative aspects as fall within the true spirit and scope of the invention.

I claim:

1. A support structure for a telescoping seating system including a plurality of seating levels, each seating level above a lowest-seating level including a foot extension member, the support structure comprising:

a support member coupled to a lower surface of a first foot extension member of a first seating level and extending downward toward an upper surface of a second foot extension member of a second seating level directly below the first seating level; and a wheel coupled to the support member, wherein the upper surface of the second foot extension member continuously supports the wheel between a closed position and an opened position of the telescoping seating system.

2. The support structure of claim 1, wherein the wheel comprises an axle, and wherein the axle is coupled to the support member at a bottom thereof.

3. The support structure of claim 2, wherein the support member comprises a tubular wheel extension having two openings at opposite sides of the bottom for accepting the axle.

4. The support structure of claim 1, wherein the first seating level comprises a discontinuous seat member, and wherein the support member is coupled to the first foot extension member such that the wheel traverses a path between the opened position and the closed position where the discontinuous seat member is absent.

5. A telescoping seating system comprising:

a plurality of seating levels, each seating level above a lowest seating level including a foot extension member;

a support member coupled to a lower surface of each foot extension member and extending downward toward an upper surface of a foot extension member of a next lower seating level; and a wheel coupled to each support member, wherein each wheel is continuously supported between a closed position and an opened position of the telescoping seating system by the upper surface of the foot extension member of the next lower seating level.

6. The telescoping seating system of claim 5, wherein each seating level comprises a discontinuous seat member, and wherein each support member is coupled to the foot extension member above such that the wheel coupled thereto traverses a path between the opened position and the closed position where the seat member is absent.

7. The telescoping seating system of claim 6, wherein the plurality of discontinuous seat members are arranged such that an aisle is created in the telescoping seating system when in the opened position.

8. The telescoping seating system of claim 7, further comprising a plurality of aisles spaced at predetermined intervals.

9. The telescoping seating system of claim 5 further comprising an intermediate stair member coupled to the upper surface of each foot extension member.

10. The telescoping seating system of claim 9, wherein each support member is positioned such that the wheel coupled thereto traverses a path between the opened position and the closed position where the intermediate stair member is absent.

11. The telescoping seating system of claim 9, wherein each intermediate stair member comprises an opening sized to allow the support member and the wheel to pass therethrough.

12. The telescoping seating system of claim 11, further comprising a railing removably coupled so as to be situated above the opening in each intermediate stair member.

13. A method of enhancing structural support for a telescoping seating system, comprising steps of:

providing a telescoping seating system including a plurality of seating levels, each seating level above a lowest seating level including a foot extension member and a wheel coupled thereto at a lower surface thereof; and continuously supporting each wheel from below between an opened position and a closed position of the telescoping seating system.

14. The method of claim 13, wherein the telescoping seating system further includes a support member coupled to the lower surface of a first foot extension member of a first seating level and extending downward toward an upper surface of a second foot extension member of a second seating level directly below the first seating level, and a wheel coupled to the support member, and wherein the step of continuously supporting comprises the upper surface continuously supporting the wheel between the opened position and the closed position.

15. A method of providing a foot-level aisle in a telescoping seating system including a plurality of seating levels, each seating level above a lowest seating level including a foot extension member, comprising steps of:

providing a support member coupled to an underside of each foot extension member; and coupling a wheel to each support member such that the wheel is continuously supported between a closed position and an opened position of the telescoping seating system by the foot extension member of the next lower seating level.

16. The method of claim 15, wherein the telescoping seating system further includes a plurality of discontinuous seat members creating spacing for at least one aisle, and wherein the step of providing comprises providing the support member in an area of each foot extension member corresponding to an absence of a discontinuous seat member in a next lower seating level such that the wheel is continuously supported by the foot extension member of the next lower seating level between the closed position and the opened position.

17. The method of claim 16, further comprising a step of coupling an intermediate stair member to an upper surface of each foot extension member in an area of the upper surface so as to avoid the support member and wheel between the opened position and the closed position.

18. The method of claim 17, wherein each intermediate stair member includes an opening sized to allow the support member and the wheel therethrough, and wherein the step of coupling the intermediate stair member comprises coupling so as to line up the opening with the support member and wheel of a next higher seating level.

19. The method of claim 18, further comprising a step of removably coupling a hand railing to each foot extension member so as to position the railing above the opening when the telescoping seating system is in the opened position.

20. A support structure for a telescoping seating system including a plurality of seating levels, each seating level above a lowest seating level including a foot extension member, the support structure comprising:

a support member integral with a lower surface of a first foot extension member of a first seating level and extending downward toward an upper surface of a second foot extension member of a second seating level directly below the first seating level; and a wheel coupled to the support member, wherein the upper surface of the second foot extension member continuously supports the wheel between a closed position and an opened position of the telescoping seating system.

21. The support structure of claim 20, wherein the wheel comprises an axle, and wherein the axle is coupled to the support member at a bottom thereof.

22. The support structure of claim 21, wherein the support member comprises a tubular wheel extension having two openings at opposite sides of the bottom for accepting the axle.

23. The support structure of claim 20, wherein the first seating level comprises a discontinuous seat member, and wherein the support member is positioned such that the wheel traverses a path between the opened position and the closed position where the discontinuous seat member is absent.

24. A telescoping seating system comprising:

a plurality of seating levels, each seating level above a lowest seating level including a foot extension member;

a support member integral with a lower surface of each foot extension member and extending downward toward an upper surface of a foot extension member of a next lower seating level; and a wheel coupled to each support member, wherein each wheel is continuously supported between a closed position and an opened position of the telescoping seating system by the upper surface of the foot extension member of the next lower seating level.

25. The telescoping seating system of claim 24, wherein each seating level comprises a discontinuous seat member, and wherein each support member is positioned such that the wheel coupled thereto traverses a path between the opened position and the closed position where the seat member is absent.

26. The telescoping seating system of claim 25, wherein the plurality of discontinuous seat members are arranged such that an aisle is created in the telescoping seating system when in the opened position.

27. The telescoping seating system of claim 26, further comprising a plurality of aisles spaced at predetermined intervals.

28. The telescoping seating system of claim 24, further comprising an intermediate stair member coupled to the upper surface of each foot extension member.

29. The telescoping seating system of claim 28, wherein each support member is positioned such that the wheel coupled thereto traverses a path between the opened position and the closed position where the intermediate stair member is absent.

30. The telescoping seating system of claim 28, wherein each intermediate stair member comprises an opening sized to allow the support member and the wheel to pass therethrough.

31. The telescoping seating system of claim 30, further comprising a railing removably coupled so as to be situated above the opening in each intermediate stair member.

32. The method of claim 13, wherein the telescoping seating system further includes a support member integral with the lower surface of a first foot extension member of a first seating level and extending downward toward an upper surface of a second foot extension member of a second seating level directly below the first seating level, and a wheel coupled to the support member, and wherein the step of continuously supporting comprises the upper surface continuously supporting the wheel between the opened position and the closed position.

33. A method of providing a foot-level aisle in a telescoping seating system including a plurality of seating levels, each seating level above a lowest seating level including a foot extension member, comprising steps of:

providing a support member integral with an underside of each foot extension member; and coupling a wheel to each support member such that the wheel is continuously supported between a closed position and an opened position of the telescoping seating system by the foot extension member of the next lower seating level.

34. The method of claim 33, wherein the telescoping seating system further includes a plurality of discontinuous seat members creating spacing for at least one aisle, and wherein the step of providing comprises providing the support member in an area of each foot extension member corresponding to an absence of a discontinuous seat member in a next lower seating level such that the wheel is continuously supported by the foot extension member of the next lower seating level between the closed position and the opened position.

35. The method of claim 34, further comprising a step of coupling an intermediate stair member to an upper surface of each foot extension member in an area of the upper surface so as to avoid the support member and wheel between the opened position and the closed position.

36. The method of claim 35, wherein each intermediate stair member includes an opening sized to allow the support member and the wheel therethrough, and wherein the step of coupling the intermediate stair member comprises coupling so as to line up the opening with the support member and wheel of a next higher seating level.

37. The method of claim 36, further comprising a step of removably coupling a hand railing to each foot extension member so as to position the railing above the opening when the telescoping seating system is in the opened position.

* * * * *